US012677887B1

(12) United States Patent
Phillips-Young

(10) Patent No.: US 12,677,887 B1
(45) Date of Patent: Jul. 14, 2026

(54) GARMENT WITH INTEGRATED STORAGE

(71) Applicant: Rose Marie Phillips-Young, Toronto (CA)

(72) Inventor: Rose Marie Phillips-Young, Toronto (CA)

( * ) Notice: Subject to any disclaimer, the term of this patent is extended or adjusted under 35 U.S.C. 154(b) by 0 days.

(21) Appl. No.: 19/267,194

(22) Filed: Jul. 11, 2025

(51) Int. Cl.
*A41D 1/04* (2006.01)
*A41D 27/20* (2006.01)

(52) U.S. Cl.
CPC ..... *A41D 1/04* (2013.01); *A41D 27/20* (2013.01)

(58) Field of Classification Search
CPC ..... A41D 1/04; A41D 27/20; A41D 1/18
See application file for complete search history.

(56) References Cited

U.S. PATENT DOCUMENTS 1,520,962 A * 12/1924 North ..... A41D 13/0012 2/102
2,607,040 A * 8/1952 Zaleski ..... A41D 13/04 2/51
3,360,802 A * 1/1968 Kasamatsu ..... A41D 23/00 2/207
2013/0117916 A1* 5/2013 Gomez ..... A41D 13/08 2/459
2015/0089712 A1* 4/2015 Gamble ..... A41D 15/00 2/88

* cited by examiner

*Primary Examiner* — Khoa D Huynh
*Assistant Examiner* — Erick I Lopez
(74) *Attorney, Agent, or Firm* — Gulf Coast Intellectual Property Group

(57) ABSTRACT

A vest having an upper portion integrally formed with a lower portion wherein the upper portion has an abbreviated length in the front tapered to a long lower rear portion that includes inner storage compartments configured to receive and store a plurality of items. The present invention includes an outer layer and an inner layer wherein an upper storage compartment and a lower storage compartment are formed on the inner layer within the upper portion of the vest. The lower storage compartment includes a wall member stitched to the inner layer to create an interior volume with an opening along the top thereof. The upper storage compartment includes an outer wall member having a closure mechanism at the top thereof providing access to a first storage partition and a second storage partition that are arranged in a vertical orientation. An outer pocket member is formed on the lower portion.

5 Claims, 4 Drawing Sheets

GARMENT WITH INTEGRATED STORAGE

FIELD OF THE INVENTION

The present invention relates generally to apparel, more specifically but not by way of limitation, an outer garment that is configured to be worn over additional apparel wherein the garment of the present invention includes a lengthened rear portion tapered from an abbreviated front and wherein the present invention includes internal storage compartments.

BACKGROUND

Throughout history, women's fashion has mirrored cultural values, social roles, and evolving notions of utility and independence. Among the garments that have undergone quiet but significant transformation is the women's vest. Initially functional and later adopted for style, the vest has long been an underutilized staple of women's wardrobes. Today, the reimagining of the vest not merely as a fashion statement, but as a functional alternative to the traditional purse marks a return to practicality, independence, and empowerment in design. The origins of the vest can be traced back to 17th-century Europe, where vests then referred to as waistcoats were integral to men's fashion. Women began wearing vest-like garments in the 19th century, primarily for equestrian pursuits and other outdoor activities. These early women's vests were tailored for modesty and form, often worn over blouses and skirts to maintain a feminine silhouette while allowing for greater movement and coverage. The 20th century saw the vest evolve into a fashionable layering piece. During the 1920s, the androgynous style popularized by flappers included tailored vests as a mark of sophistication and modernity. Later, in the 1960s and 1970s, vests took on a bohemian flair, made from suede, denim, or crochet and often paired with long skirts or bell-bottom jeans. Despite these stylistic shifts, the women's vest remained largely ornamental, lacking the utilitarian aspects often found in menswear.

One consistent limitation in women's fashion, especially in comparison to men's, has been the lack of practical storage options. While men's jackets and pants routinely feature functional pockets, women have long relied on handbags or purses for their personal items. This design disparity is both a fashion norm and a practical inconvenience one that has implications for freedom of movement, safety, and convenience. Even as women entered the workforce in increasing numbers during the 20th century, carrying a purse remained a social expectation. This reliance can pose challenges in modern settings where minimalism and mobility are prized such as during travel, commuting, or even attending events where large bags are discouraged or prohibited. In response to these concerns, the modern redesign of the women's vest to include internal pockets is both a stylish and empowering innovation. By integrating thoughtfully concealed yet spacious compartments, these vests offer women an alternative to the traditional handbag. A fashionable vest with internal storage not only allows for hands-free convenience but also supports a minimalist lifestyle and enhances security by reducing the risk of theft.

Additionally, such a garment can be tailored in diverse styles from business-chic to casual outdoor wear making it adaptable to multiple settings. When crafted from high-quality materials and designed with aesthetic sensibility, the vest retains its stylish appeal while incorporating functional benefits that have long been absent from women's fashion.

The history of the women's vest reflects broader shifts in gender roles, fashion norms, and social expectations. While once a modest, decorative accessory, the vest now holds untapped potential as a functional and fashionable solution to a long-standing problem in women's apparel. By developing a women's vest with internal pockets, designers can address the limitations of purse dependence, offering women greater mobility, security, and freedom. In this evolution, the vest becomes more than a garment it becomes a symbol of autonomy, practicality, and modern style.

Accordingly, there is a need for a vest that includes inner storage compartments integrally formed on the interior lining thereof wherein the present invention includes an upper storage compartment and a lower storage compartment formed within the interior lining.

SUMMARY OF THE INVENTION

It is the object of the present invention to provide a garment that is configured to be worn over additional garments wherein the garment body has an abbreviated front portion.

Another object of the present invention is to provide a garment that includes integrated storage compartments wherein the garment body transitions from an abbreviated front portion to an elongated rear portion.

A further object of the present invention is to provide a garment that is configured to be worn over additional garments wherein the garment body includes an internal lining layer.

Yet a further object of the present invention is to provide a garment that includes integrated storage compartments wherein the internal lining layer includes a storage compartment integrally formed therein.

Still another object of the present invention is to provide a garment that is configured to be worn over additional garments wherein the storage compartment includes a plurality of partitions providing isolated storage of items.

An additional object of the present invention is to provide a garment that includes integrated storage compartments wherein the storage compartment includes a first compartment having an opening secured with a zipper.

Yet a further object of the present invention is to provide a garment that is configured to be worn over additional garments wherein the garment in a preferred embodiment has an exterior layer manufactured from denim.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
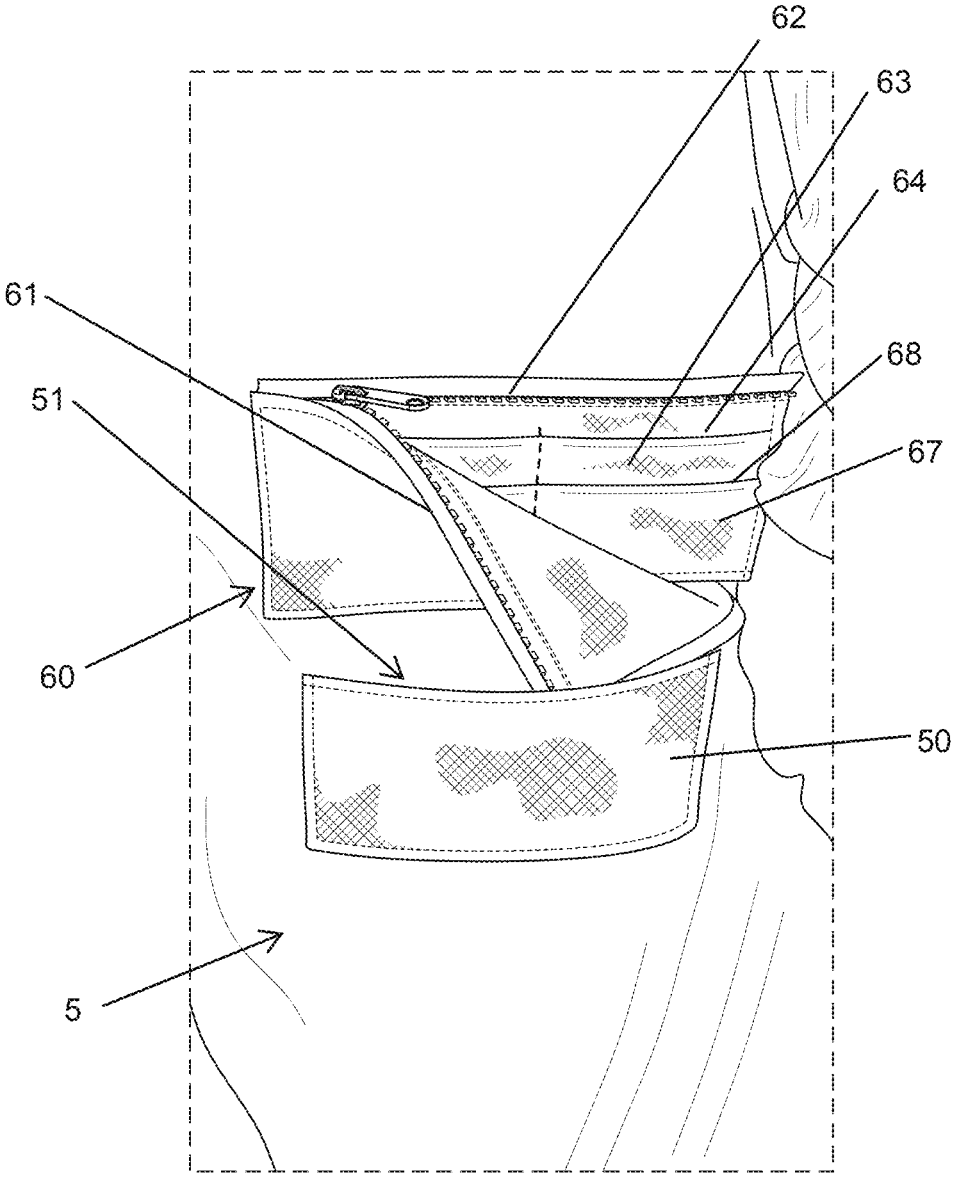
FIG. 1 is a detailed view of the storage compartments of the present invention.
Figure 2:
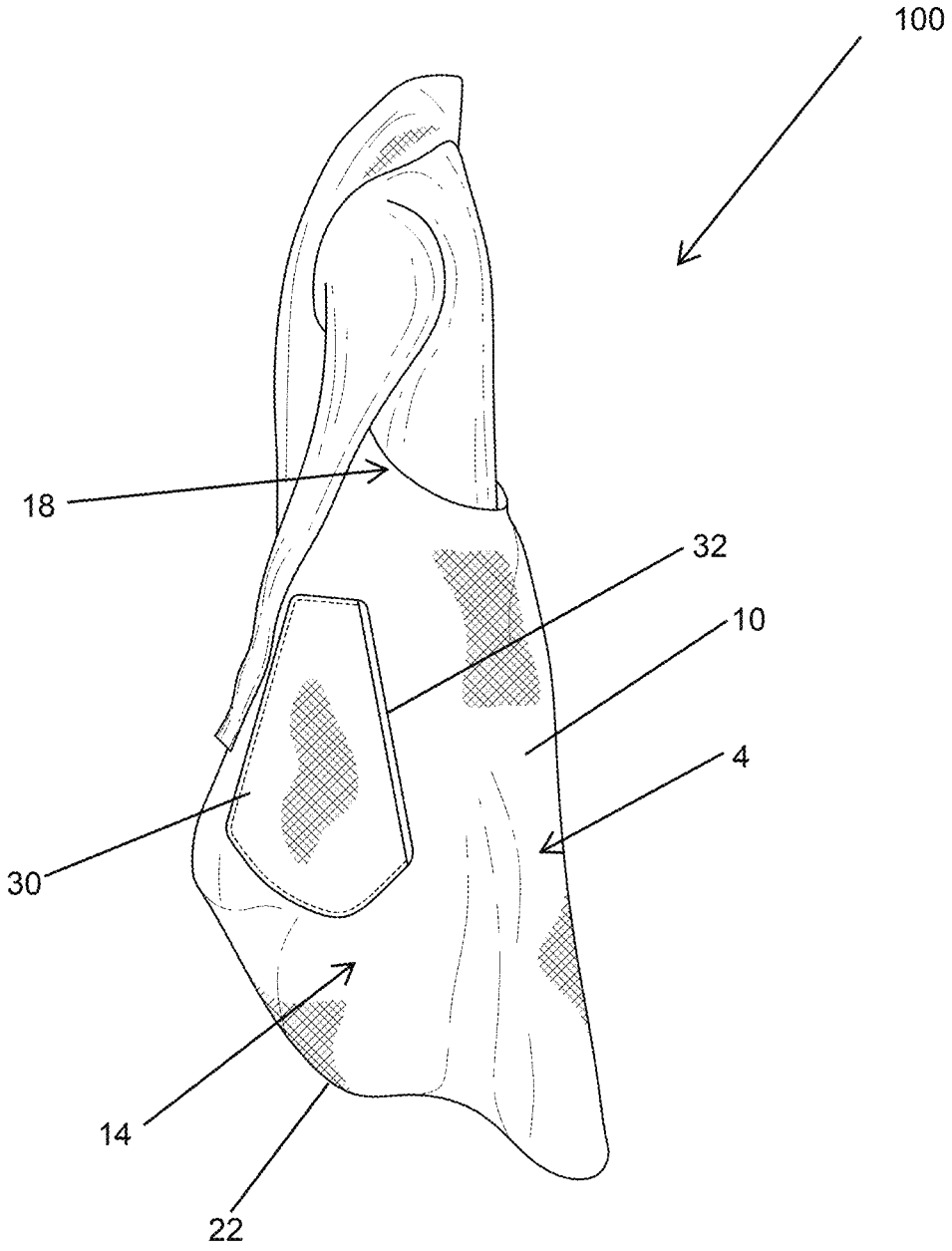
FIG. 2 is a left side view of the preferred embodiment of the present invention.
Figure 3:
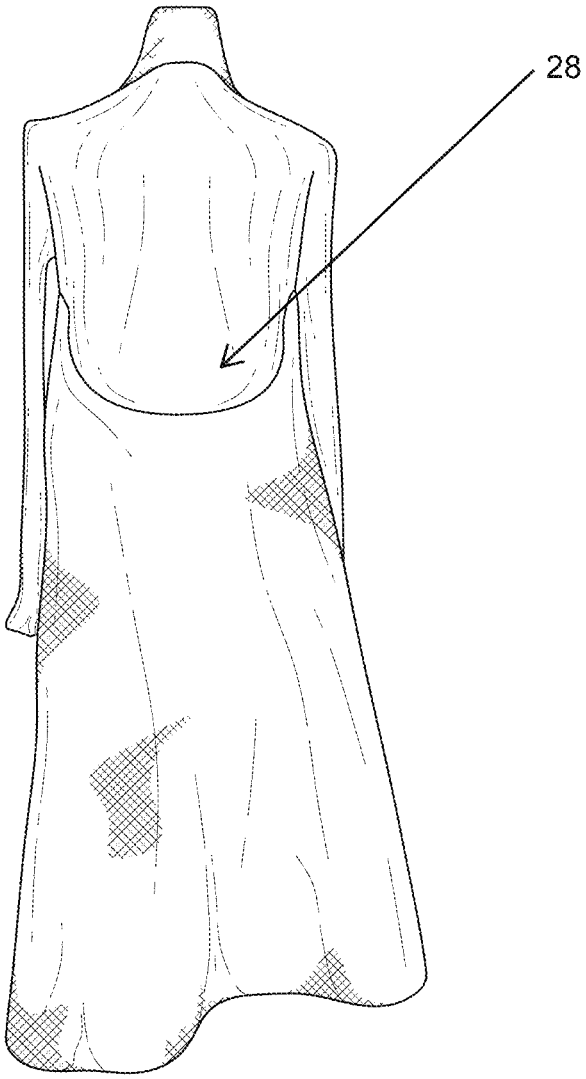
FIG. 3 is a rear view of the preferred embodiment of the present invention.
Figure 4:
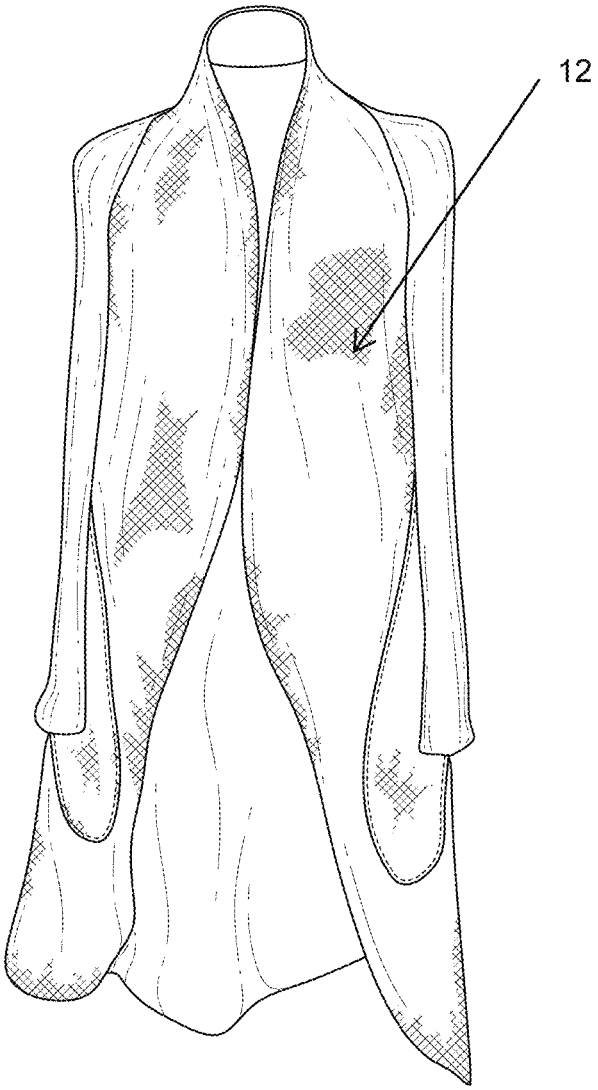
FIG. 4 is a front view of the preferred embodiment of the present invention.

Referring now to the drawings submitted herewith, wherein various elements depicted therein are not necessarily drawn to scale and wherein through the views and figures like elements are referenced with identical reference numerals, there is illustrated a garment having integrated storage 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the garment having integrated storage 100 is illustrated herein in a preferred embodiment. While in a preferred embodiment the garment having integrated storage 100 is manufactured having a cotton liner and denim outer layer, it should be understood within the scope of the present invention that the garment having integrated storage 100 could be manufactured from alternate materials and be provided in various colors and sizes.

The garment having integrated storage 100 includes a body 10 wherein the body 10 is manufactured from conventional fabrics. The body 10 includes an upper portion 12 having a neck member 15. Upper portion 12 is contiguous with the lower portion 14. Neck member 15 is configured to be posteriorly positioned on a wearer's neck and extend downward into the torso portion 18 of the body 10. The torso portion 18 includes opposing longitudinal edges that taper downward towards the lower portion 14. Lower portion 14 includes a lower perimeter edge 22 that is tapered in form so as to create a lower portion 14 that is longer in the rear of the garment having integrated storage 100 as compared to the front of the garment having integrated storage 100. The neck member 14 is integrally formed with the torso portion 18 to create rear aperture 28. The rear aperture 28 provides exposure of substantially all of the rear of the wearer's torso.

Formed in the outer layer of the body 10 is a pocket member 30. The pocket member 30 includes an opening 32 wherein the opening 32 provides access to an interior volume that is intermediate the outer layer 4 and inner layer 5 of the body 10. It is contemplated within the scope of the present invention that the pocket member 30 could be provided in alternate sizes. Furthermore, it should be understood within the scope of the present invention that the pocket member 30 in a preferred embodiment of the garment having integrated storage 100 is provided on both the left side and right side of the body 10.

The garment having integrated storage 100 includes a lower storage compartment 50 formed on the inner layer 5 of the body 10. The lower storage compartment 50 is rectangular in shape having an opening 51 providing access to an interior volume thereof. In a preferred embodiment of the garment having integrated storage 100 the lower storage compartment 50 does not have a closure mechanism on the opening 51 so as to provide ease of deposit and retrieval of larger objects such as but not limited to a cellular phone. The garment having integrated storage 100 further includes an upper storage compartment 60. The upper storage compartment 60 is formed utilizing outer wall member 61 wherein outer wall member 61 is stitched to inner layer 5 utilizing suitable techniques. The outer wall member 61 is formed to have an opening that is operated with closure mechanism 62. While a zipper is illustrated herein for a closure mechanism 62, it is contemplated within the scope of the present invention that the closure mechanism 62 could be manufactured from alternate conventional fasteners such as but not limited to hook and loop. Formed within the upper storage compartment is a first storage partition 64 having wall member 63 and a second storage partition 68 having wall member 67. The wall member 63 is secured utilizing suitable techniques such as but not limited to stitching. Similarly, the wall member 67 is secured utilizing the same techniques as the wall member 63. The first storage partition 64 and second storage partition 68 are configured to receive and retain therein items such as but not limited to credit cards. While a first storage partition 64 and a second storage partition 68 are illustrated and discussed herein, it is contemplated within the scope of the present invention that the upper storage compartment 60 could have a single storage partition or more than two storage partitions. While the garment having integrated storage 100 in a preferred embodiment has a lower storage compartment 50 and an upper storage compartment 60, it is contemplated within the scope of the present invention that the garment having integrated storage 100 could have more than one lower storage compartment 50 and more than one upper storage compartment 60.

In the preceding detailed description, reference has been made to the accompanying drawings that form a part hereof, and in which are shown by way of illustration specific embodiments in which the invention may be practiced.

These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A vest having integrated storage wherein the vest comprises:

a body, said body having an upper portion and a lower portion, said upper portion having a neck member integrally formed with a torso portion, said neck member and said torso portion having a rear aperture, said torso portion being contiguous with said lower portion, said lower portion having a lower edge wherein the lower edge tapers downward from a front area of the body to a rear area of the body, said front area of said body being adjacent front of a wearer and said rear area of said body being adjacently below a buttocks region of a wearer, said body having an outer layer and an inner layer;

a lower storage compartment, said lower storage compartment having a wall member secured to the inner layer of said body, said lower storage compartment having an opening along a top edge thereof, said lower storage compartment being rectangular in shape;

an upper storage compartment, said upper storage compartment being secured to said inner liner proximate said lower storage compartment, said upper storage compartment having an outer wall member, said outer wall member having a closure mechanism secured along a top edge thereof, said outer wall member being separable from said inner liner along said closure mechanism to expose a first storage partition and a second storage partition, wherein said first storage partition is disposed within an interior volume of said upper storage compartment.

2. The vest having integrated storage as recited in claim 1, wherein said lower portion of said body further includes at least one outer pocket member, said at least one outer pocket member formed on the outer layer of the body, said at least one outer pocket member having an opening providing access to an interior volume that is intermediate the inner layer and outer layer of said body.

3. The vest having integrated storage as recited in claim 2, wherein said second storage partition having a wall member and an opening along a top edge thereof.

4. The vest having integrated storage as recited in claim 3, wherein said first storage partition and second storage partition are arranged in a vertically stacked formation.

5. The vest having integrated storage as recited in claim 4, wherein said outer layer of said body is manufactured from a first material and said inner layer of said body is manufactured from a second material.

* * * * *